US011111633B2

(12) United States Patent
Satake Neto et al.

(10) Patent No.: US 11,111,633 B2
(45) **Date of Patent: *Sep. 7, 2021**

(54) TISSUE PRODUCTS HAVING MACROFOLDS

(71) Applicant: Kimberly-Clark Worldwide, Inc., Neenah, WI (US)

(72) Inventors: Tsutama Satake Neto, Sao Paolo (BR); Patricia Camara Mileo, Sao Paolo (BR); Jorge Alonso Duran, Sao Paolo (BR)

( * ) Notice: Subject to any disclaimer, the term of this patent is extended or adjusted under 35 U.S.C. 154(b) by 0 days.

This patent is subject to a terminal disclaimer.

(21) Appl. No.: 16/955,651

(22) PCT Filed: Aug. 29, 2019

(86) PCT No.: PCT/US2019/048687
§ 371 (c)(1),
(2) Date: Jun. 18, 2020

(87) PCT Pub. No.: WO2021/040711
PCT Pub. Date: Mar. 4, 2021

(65) Prior Publication Data

US 2021/0062432 A1 Mar. 4, 2021

(51) Int. Cl.

| | |
|---|---|
| ***D21H 27/40*** | (2006.01) |
| ***D21F 11/14*** | (2006.01) |
| ***D21F 11/00*** | (2006.01) |
| ***D21H 27/00*** | (2006.01) |

(52) U.S. Cl.
CPC ..... *D21H 27/40* (2013.01); *D21F 11/006* (2013.01); *D21F 11/14* (2013.01); *D21H 27/002* (2013.01)

(58) Field of Classification Search
USPC ..... 162/113
See application file for complete search history.

(56) References Cited

U.S. PATENT DOCUMENTS

| | | | | |
|---|---|---|---|---|
| 3,940,529 | A | 2/1976 | Hepford et al. | |
| 4,100,017 | A | 7/1978 | Flautt | |
| 4,469,735 | A * | 9/1984 | Trokhan | A47L 13/16 428/154 |
| 5,814,190 | A * | 9/1998 | Van Phan | B29C 39/18 162/109 |
| 5,865,824 | A * | 2/1999 | Chen | A61F 13/53747 604/378 |
| 5,894,046 | A | 4/1999 | Kim et al. | |
| 5,980,673 | A * | 11/1999 | Takeuchi | A47K 10/16 156/183 |
| 6,060,149 | A * | 5/2000 | Nissing | B32B 29/02 428/138 |
| 6,146,496 | A * | 11/2000 | Phan | D21F 11/006 162/113 |
| 6,153,037 | A | 11/2000 | Kim et al. | |
| 6,200,419 | B1 * | 3/2001 | Phan | B29C 39/18 162/109 |
| 6,458,447 | B1 | 10/2002 | Cabell et al. | |
| 6,913,673 | B2 | 7/2005 | Baggot et al. | |
| 7,611,607 | B2 | 11/2009 | Mullally et al. | |
| 7,846,531 | B2 * | 12/2010 | Basler | B31F 1/07 428/154 |
| 8,409,404 | B2 | 4/2013 | Harper et al. | |
| 2003/0121628 | A1 | 7/2003 | Mills et al. | |
| 2015/0053349 | A1 | 2/2015 | Mori et al. | |
| 2016/0002861 | A1 | 1/2016 | Goulet et al. | |

FOREIGN PATENT DOCUMENTS

| | | | |
|---|---|---|---|
| CN | 2855726 | Y | 1/2007 |
| CN | 109259640 | A | 1/2019 |
| GB | 253979 | A | 6/1926 |
| GB | 928462 | A | 6/1963 |
| WO | 17165919 | A1 | 10/2017 |

OTHER PUBLICATIONS

Cottonelle, "Cottonelle CleanCare Toilet Ripple Paper", https://www.amazon.com/Cottonelle-CleanCare-Toilet-Paper-Tissue/dp/B01AFRSPZY.
Make How, "Corrugated Cardboard", Jul. 12, 2018, http://www.madehow.com/Volume-1/Corrugated-Cardboard.html.
Co-Pending U.S. Appl. No. 16/955,635, filed Jun. 18, 2020, by Neto et al. for "Tissue Products Having Macrofolds".

* cited by examiner

*Primary Examiner* — Mark Halpern
(74) *Attorney, Agent, or Firm* — Kimberly-Clark Worldwide, Inc.

(57) ABSTRACT

The present invention provides multi-ply tissue products having distinctly different first and second outer surfaces or sides. The two-sidedness is generally provided by forming one of the surfaces from a tissue ply having a plurality of macrofolds and the other side from a substantially planar tissue ply. The first ply may be attached to the second ply at longitudinally spaced apart points that define a macrofold therebetween. The length of tissue between the points of attachment may form a wave-like structure having an amplitude and wavelength and having a transversely orientated void that extends from a first edge to a second edge of the tissue. The combination of these elements provides a tissue product that is both aesthetically pleasing and well suited to cleaning due to the large amount of surface area created by the macrofolds.

7 Claims, 7 Drawing Sheets

TISSUE PRODUCTS HAVING MACROFOLDS

BACKGROUND

Products made from paper webs such as bath tissues, facial tissues, paper towels, industrial wipers, food service wipers, napkins, medical pads and other similar products are designed to include several important properties. For example, for most applications, the product should be highly absorbent. In addition, products often should include surface texture in order to provide, for example, a good wiping surface in the case of wiping products or a soft surface texture in products which may be used while in contact with skin. Moreover, absorbent paper products which are multi-ply laminated products should avoid delamination under conditions of use.

Methods for increasing texture at the surface of a paper product are well known in the art. One well-known method is embossing, wherein the fibers in the web are mechanically deformed under high mechanical pressure to impart kinks and microcompressions in the fibers that remain substantially permanent while the web is dry. When wetted, however, the fibers may swell and straighten as the local stresses associated with the kinks or microcompressions in the fiber relax. Thus, embossed tissue when wetted tends to lose much of the added surface texture imparted by embossing and tends to collapse back to a relatively flat state. Similar considerations apply to the fine texture imparted to tissue by creping or microstraining, for such texture is generally due to local kinks and microcompressions in the fibers that may be relaxed when the tissue is wetted, causing the tissue to collapse toward a flatter state than it was in while dry.

Thus, there is a need for a method of converting a dry tissue web or other porous web into a structure having enhanced texture and physical properties. Moreover, there is a need for a highly textured paper product which may maintain a highly textured surface even after becoming wet.

SUMMARY

It has now been discovered that tissue products having a highly textured surface may be produced by providing one of the plies forming a multi-ply tissue product with a plurality of macrofolds. The ply comprising the macrofolds may be attached to a conventional, generally planar, tissue ply to provide the dual sided multi-ply tissue product. In certain preferred embodiments the multi-ply product may comprise a first ply, which forms the upper most surface of the product, attached to a substantially planar second ply at longitudinally spaced apart points that define macrofolds therebetween. The length of tissue between the points of attachment may form a wave-like structure having an amplitude and wavelength and having a transversely orientated void that extends from a first edge to a second edge of the tissue. The combination of these elements provides a tissue product that is both aesthetically pleasing and particularly well suited to cleaning due to the large amount of surface area created by the macrofolds.

Accordingly, in one embodiment the present invention provides a tissue product having a machine direction (MD) and a cross-machine direction (CD), a first surface and an opposed bottom surface, the product comprising: a multi-ply tissue web having a first and a second ply, a plurality of spaced apart and repeating lines of perforation disposed on the web, the perforations spaced apart from one another in the MD and defining a plurality of sheets therebetween, the sheets having a sheet length (L); wherein the MD length of the first ply is substantially equal to the sheet length (L) and the MD length of the second ply is at least about 200 percent of the sheet length (L).

In another embodiment the present invention provides a multi-ply tissue product having a machine direction (MD) and a cross-machine direction (CD), a first surface and an opposed bottom surface, a first edge and an opposite second edge, the product comprising: a first ply comprising a plurality of wave-shaped macrofolds extending in the CD from the first edge to the second edge, each macrofold extending in the MD between first and second attachment points and having a MD segment length; and a substantially planar second ply.

In yet another embodiment the present invention provides a multi-ply tissue product having a machine direction (MD) and a cross-machine direction (CD), a first surface and an opposed bottom surface, the product comprising: a first ply comprising a plurality of CD orientated macrofolds, each macrofold having a valley, a peak and a substantially similar uniform wavelength and amplitude, and a substantially planar second ply, wherein the first and second plies are attached to one another by an adhesive disposed between a macrofold valley and the second ply.

In still other embodiments the present invention provides a method of manufacturing a multi-ply tissue product having a machine direction (MD) and a cross-machine direction (CD), a first outer surface, a second outer surface and a plurality of macrofolds disposed on at least one of its outer surfaces comprising the steps of: (a) conveying a first tissue ply through a first nip created by opposed first and second engraved rolls to form a tissue ply having a plurality of macrofolds; (b) applying an adhesive to the macrofolds while supported by the second engraved roll; (c) conveying a second tissue ply through a second nip created by an engraved embossing roll and a substantially smooth resilient roll in opposition to one another to form an embossed tissue ply; (d) conveying the macrofolded tissue ply and embossed tissue plies through a third nip created by the second engraved roll and a marrying roll in opposition to one another; (e) attaching the macrofolded tissue ply and embossed tissue plies to one another by contacting the adhesively treated macrofolds and the embossed tissue ply to one another in the third nip.

DEFINITIONS

Figure 1:
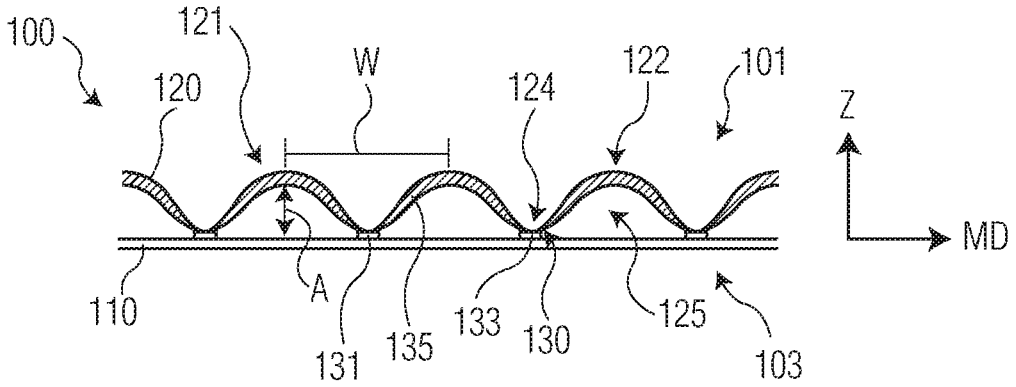
FIG. 1 is a side view of a tissue product according to one embodiment of the present invention.

As used herein the term "tissue ply" refers to a structure comprising a plurality of fibers such as, for example, papermaking fibers and more particularly pulp fibers, including both wood and non-wood pulp fibers, and synthetic staple fibers. A non-limiting example of a tissue ply is a wet-laid sheet material comprising pulp fibers having a basis weight from about 10 to about 45 grams per square meter (gsm), such as from about 13 to about 42 gsm and a sheet bulk greater than about 5 cc/g, such as from about 5 to about 12 cc/g.

As used herein, the term "tissue product" refers to products made from one or more tissue plies and includes, for example, rolled bath tissue, sheets of facial tissue, paper towels, industrial wipers, foodservice wipers, napkins, medical pads, and other similar products. In certain preferred embodiments tissue products of the present invention comprise two or more plies, such as two, three or four plies. Each of the plies of a multi-ply tissue product may be substantially identical, or they may be different, such as having been made by a different tissue manufacturing process or possess at least one physical characteristic such as, for example, tensile strength, stretch, basis weight, or sheet bulk, that differs.

As used herein, the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "machine direction" of a web, ply, or product is the direction within the plane of web, ply, or product parallel to the principal direction of travel of the structure during manufacture. The cross-machine direction is generally orthogonal to the machine direction and also lies within the plane of structure. The Z-direction is orthogonal to both the machine direction and cross-machine direction and generally normal to the plane of structure. The machine direction, cross machine direction, and Z-direction form a Cartesian coordinate system.

As used herein, the term "basis weight" generally refers to the bone-dry weight per unit area of a tissue and is generally expressed as grams per square meter (gsm). Basis weight is measured using TAPPI test method T-220.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone-dry basis weight (gsm). The resulting sheet bulk is expressed in cubic centimeters per gram (cc/g).

As used herein, the terms "geometric mean tensile" (GMT) refers to the square root of the product of the machine direction tensile strength and the cross-machine direction tensile strength of the web.

As used herein the term "line of perforations" generally refers to a line of weakness, such as a plurality of perforations, extending in the transverse cross-machine directional of the web from a first edge to a second edge and providing a means of separating adjacent sheets from one another. The line of perforations may be linear or non-linear.

As used herein the term "sheet" generally refers to a portion of tissue in a rolled tissue product bounded by transverse lines of perforation as is commonly understood in the tissue industry.

As used herein the term "sheet length" generally refers to the distance between a pair of spaced apart transverse lines of perforations defining a sheet. The minimum and maximum sheet lengths are generally determined by the nature of the sheet material product and the needs and preferences of the user. In certain instances, the tissue product may comprise a rolled bath tissue product having a sheet length of about 10 cm or greater, such as from about 10 to about 15 cm.

As used herein the term "macrofold" generally refers to a non-planar portion of a tissue ply having a machine direction ply length that exceeds the machine direction length. In those embodiments where the multi-ply tissue product comprises a ply having a plurality of macrofolds disposed thereon, the macrofolds are generally the portion of the ply extending between two points of attachment. For example, with reference to FIG. 1, the macrofold 121 is formed from a portion of the top ply 120 and extends between first and second points of attachment 131, 133. The first and second points of attachment 131, 133 are formed by an adhesive 130 disposed between the bottom ply 110 and the top ply 120. In certain preferred embodiments a macrofold 121 may have a wave-like shape with a peak 122 and a trough or valley 124 and have an amplitude and wavelength. In particularly preferred embodiments, individual plies of a multi-ply product may be attached to one another by an adhesive 130 disposed between a first ply 110 and the macrofold valley 124 of a second ply 120.

As used herein the term "macrofold segment length" refers to the machine direction (MD) length of the tissue ply forming a macrofold between first and second points of attachment. For example, with reference to FIG. 1, the macrofold 121 has a segment length 135 (shaded portion between points of attachment 131, 133) extending between first and second points of attachment 131, 133, as measured in the machine direction (MD).

DETAILED DESCRIPTION

The present invention provides multi-ply tissue products having distinctly different first and second outer surfaces or sides. The two-sidedness is generally provided by forming one of the surfaces from a tissue ply, such as a first upper tissue ply, having a plurality of macrofolds and the other side from a substantially planar tissue ply. For example, the first ply may be attached to the second ply at longitudinally spaced apart points that define a macrofold therebetween. The length of tissue between the points of attachment may form a wave-like structure having an amplitude and wavelength and having a transversely orientated void that extends from a first edge to a second edge of the tissue. The combination of these elements provides a tissue product that is both aesthetically pleasing and particularly well suited to cleaning due to the large amount of surface area created by the macrofolds.

The multi-ply embossed tissue products of the present invention generally comprise two, three or four tissue plies made by well-known wet-laid papermaking processes such as, for example, creped wet pressed, modified wet pressed, creped through-air dried (CTAD) or uncreped through-air dried (UCTAD). For example, creped tissue webs may be formed using either a wet pressed or modified wet pressed process such as those disclosed in U.S. Pat. Nos. 3,953,638, 5,324,575 and 6,080,279, the disclosures of which are incorporated herein in a manner consistent with the instant application. In these processes the embryonic tissue web is transferred to a Yankee dryer, which completes the drying process, and then creped from the Yankee surface using a doctor blade or other suitable device.

In other instances, the tissue plies may be formed by a through-air dried process known in the art. In such processes the embryonic web is noncompressively dried. For example, textured tissue plies may be formed by either creped or uncreped through-air dried processes. Particularly preferred are uncreped through-air dried webs, such as those described in U.S. Pat. No. 5,779,860, the contents of which are incorporated herein in a manner consistent with the present disclosure.

In still other instances, the tissue plies may be manufactured by a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; or fabric creped tissue, made using a process including the step of transferring the wet web from a carrying surface (belt, fabric, felt, or roll) moving at one speed to a fabric moving at a slower speed (at least 5 percent slower) and subsequently drying the sheet. Those skilled in the art will recognize that these processes are not mutually exclusive, e.g., an uncreped TAD process may include a fabric crepe step.

The instant multi-ply tissue product may be constructed from two or more plies that are manufactured using the same or different tissue making techniques. In a particularly preferred embodiment, the multi-ply tissue product comprises three plies where each of the plies comprises a wet-pressed tissue ply, where each ply has a basis weight greater than about 10 gsm, such as from about 10 to about 45 gsm, such as from about 12 to about 42 gsm.

Regardless of the tissue making process used to produce the individual plies, the resulting multi-ply tissue product has a first surface having a plurality of macrofolds. As shown in FIG. 1, the tissue product may be in the form of a two-ply tissue product 100 having an upper surface 101 and an opposed bottom surface 103. The product 100 is formed from first and second tissue plies 110, 120. The first tissue ply 110, also referred to the bottom ply, forms the bottom surface 103 and the second ply 120, also referred to as the upper ply, forms the upper surface 101.

The first ply 110 is substantially planar and in certain instances may comprise a plurality of embossments. The second ply 120 comprises a plurality of macrofolds 121. Each macrofold 121 generally extends between first and second points of attachment 131, 133, which in certain preferred embodiments are formed by an adhesive 130 disposed between the first and second plies 110, 120. In a particularly preferred embodiment, individual plies of a multi-ply product may be attached to one another by an adhesive 130 disposed between a first ply 110 and the macrofold valley 124 of a second ply 120. In other embodiments, macrofold ends may be joined to the bottom ply using other well-known ply attachment means such as mechanical crimping or embossing.

In a particularly preferred embodiment, each of the plurality of macrofolds 121 are similarly sized. For example, the points of attachment 131, 133 defining each of the macrofolds 121 may be spaced apart an equal distance, such as at least about 8.5 mm, such as from about 5.0 to about 16 mm, such as from about 7.0 to about 10 mm. Further, the macrofold segment length 135 (shaded portion between points of attachment 131, 133), may range from about 8.0 to about 24 mm, such as from about 10 to about 22 mm, such as from about 12 to about 20 mm. In certain preferred embodiments each of the macrofolds has a ratio of macrofold segment length to attachment length greater than 2.0 mm, and more preferably greater than about 3.0 mm, such as from about 2.5 to about 4.5 mm, such as from about 3.0 to about 4.0 mm.

Figure 2:
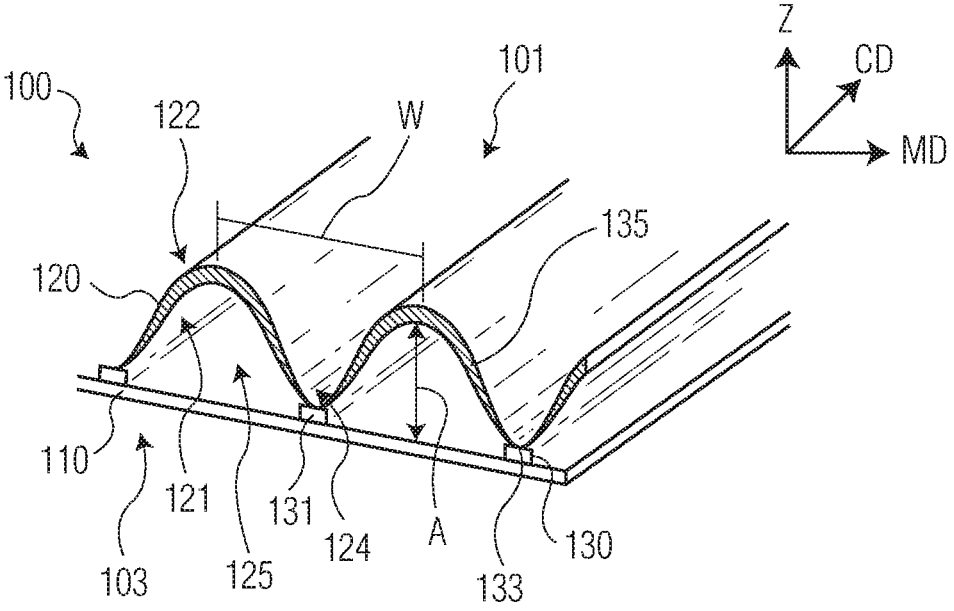
FIG. 2 is a perspective view of a tissue product according to one embodiment of the present invention.

In a particularly preferred embodiment, such as illustrated in FIGS. 1 and 2, the plurality of macrofolds 121 may have a wave-like shape. The wave-like macrofolds 121 have an amplitude (A) and a wavelength (W). In certain instances, the amplitude may range from about 3.0 to about 20 mm, such as from about 5.0 to about 15 mm, and the wavelength may range from about 5.0 to about 15 mm, such as from about 6.0 to about 12 mm. The dimensions of wave-like macrofolds may be measured using conventional imaging techniques by inverting the tissue product (where the macrofolds are disposed on an upper surface of the tissue product), apply sufficient tension to make the first ply planar (where the first ply forms the bottom surface of the tissue product and is devoid of macrofolds) and allowing the macrofolds to hang freely.

As further illustrated in FIGS. 1 and 2, the macrofolds 121 may define a void 125 extending transversely in the cross-machine direction from a first edge of the sheet to the second edge. In a particularly preferred embodiment, the void extends continuously from a first edge of the sheet to the second edge. In those instances where each of the plurality of macrofolds is substantially similar in terms of shape and size, the voids defined thereby will also be similarly shaped and sized.

With continued reference to FIG. 1, the first ply 110, which forms the bottom surface 103 of the tissue product 100 is generally void of macrofolds. Rather than possess macrofolds, the first ply is preferably planar. Although it is generally preferred that the first ply be planar, the ply may possess texture or topography that may be non-planar on the microscale. For example, the first ply may be macroscopically planar despite having a plurality of embossments or having a textured surface as the result of having been formed by wet molding.

In certain embodiments, one or more of the outer most plies of the tissue product may comprise a plurality of embossments. In one preferred embodiment, the first ply, which generally forms the bottom surface of the tissue product, may have a total embossed area from about 5 to about 40 percent, more preferably ranging from about 8 to about 35 percent, even more preferably ranging from about 20 to about 25 percent. In a preferred embodiment, only embossed elements that are completely disposed upon the tissue sheet surface are utilized for the calculation of total embossment footprint area. However, one of skill in the art would be able to utilize such fractional portions of embossed elements in accordance with the present invention to determine the appropriate relationship of total embossment footprint area to total surface area of a tissue sheet.

Without desiring to be bound by theory, an optimized percentage of the tissue surface area covered by the embossing pattern, such as from about 5 about 40 percent, and more preferably from about 8 to about 25 percent, and the pattern consisting essentially of organic shaped embossed elements formed from dot emboss elements communicates to the consumer that the product is soft and cushiony. Additionally, at the foregoing area coverage and shapes the emboss pattern has an aesthetic quality that does not appear overly complicated but simplistic and natural.

Figure 3A:
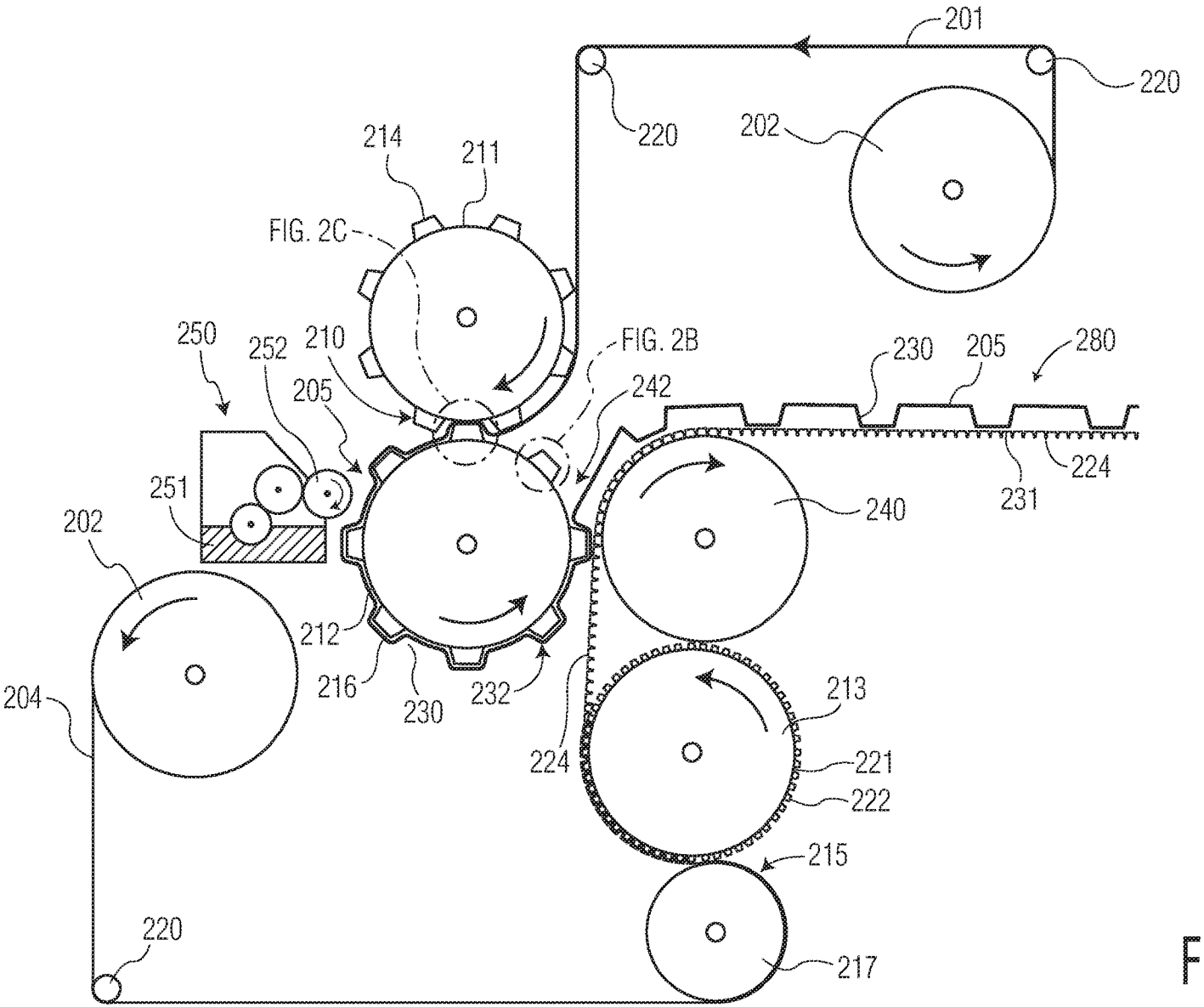
FIG. 3A is a schematic view of a process for manufacturing a tissue product according to one embodiment of the present invention.

The tissue products of the present invention, in particular embodiments, may be manufactured by a process whereby the top ply is deformed in such a way that, when combined with a bottom ply, a plurality of macrofolds are formed. One suitable process is illustrated in FIG. 3A. As shown in FIG. 3A, a first tissue ply 201, which will form the uppermost ply of the finished tissue product, is unwound from a first parent roll 202 and conveyed past a series of idler rollers 220 towards a first embossing nip 210 located between first and second engraved rolls 211, 212. In the illustrated embodiment the first engraved roll 211 rotates clockwise and the second engraved roll 212 rotates in a counterclockwise direction.

The first and second engraved rolls 211, 212 are generally hard and non-deformable rolls, such as a steel roll, and comprise first and second protuberances 214, 216. The protuberances extend radially from a first peripheral surface of the rolls and are arranged to form a meshing engagement when the rolls are brought together to form a nip. The protuberances have a radial height generally measured from the first peripheral surface of the roll, which is understood to be the circumferential surface of the roll having the least radial height when measured from the axis of the roll, or some other common reference point. In certain embodiments the radial height of the protuberances 214 disposed on the first roll 211 may have a height of about 3.0 mm or greater, such as from about 3.0 to about 20 mm and more preferably from about 6.0 to about 15 mm. The radial height of the protuberances 216 disposed on the second roll 212 may have a height of about 3.0 mm or greater, such as from about 6.0 to about 20 mm and more preferably from about 8.0 to about 14 mm.

The protuberances 214, 216 of the first and second engraved rolls 211, 212 extend generally transversely in the cross-machine direction along the entire width of the rolls. The protuberances 214, 216 are spaced apart from one another and have land areas disposed therebetween. Preferably the land areas, like the protuberances are continuous within a given dimension of the engraved roll.

Figure 3B:
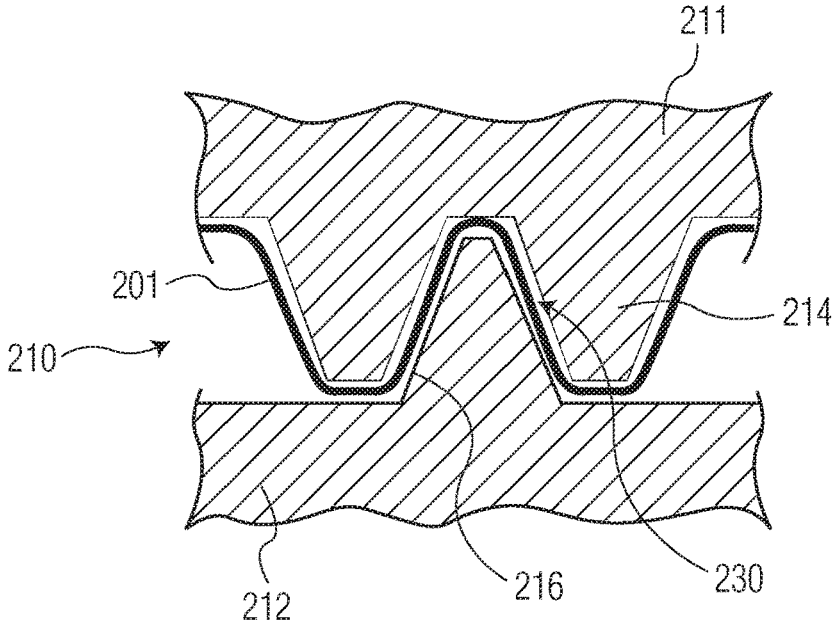
FIGS. 3B and 3C are detailed views of various elements of the process illustrated in FIG. 3A.

The spacing and arrangement of the protuberances on each of the first and second rolls may vary depending on the desired tissue product properties and appearance. The shape of the element may also be varied to provide the desired tissue product properties and appearance. For example, in one embodiment, such as that illustrated in FIG. 3B, the protuberances 214 disposed on the first engraved roll 211 have a truncated triangle cross-sectional profile and the protuberances 216 disposed on the second engraved roll 212 have a triangular cross-sectional profile. In certain preferred embodiments, such as that detailed in FIG. 3C, the protuberances 214 disposed on the first engraved roll 211 may have a second set of protuberances 261 disposed on the planar upper portion 263 thereof.

Figure 3C:
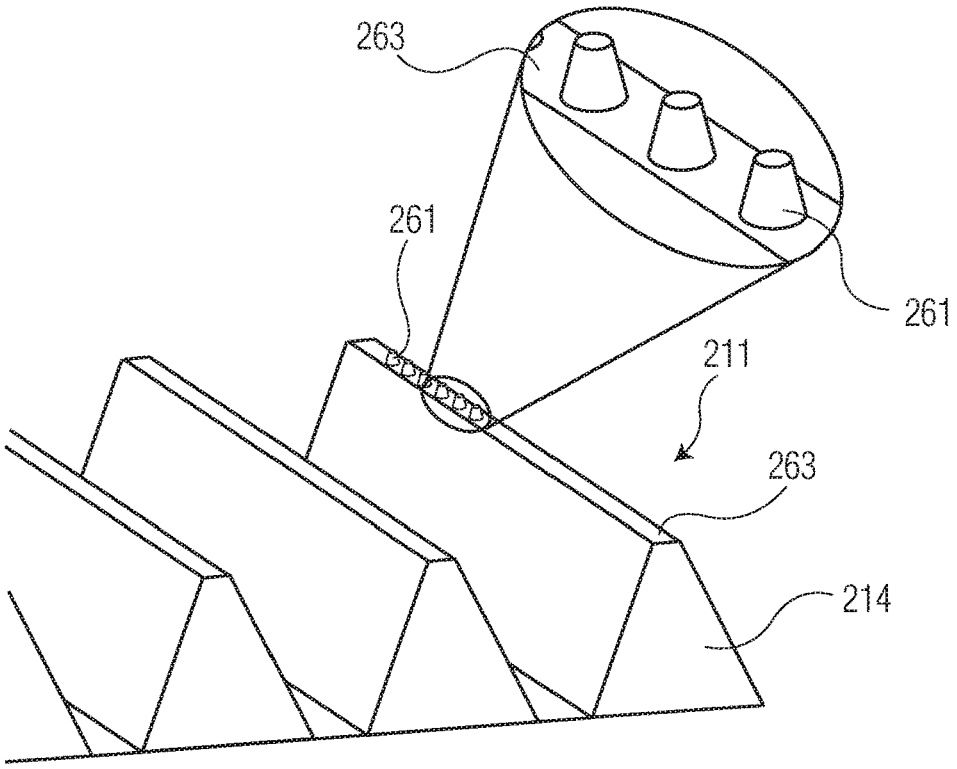

In those embodiments where the protuberances 214 of the first engraved roll 211 are provided with a second set of protuberances 261, which may have any number of different shapes and may be provided to emboss the first tissue ply along a portion of the ply between the spaced apart macrofolds. In a particularly preferred embodiment, such as illustrated in FIG. 3C, the second set of protuberances 261 may be regularly spaced across the entire width of the protuberance 214 and have a truncated conical shape. The size of the second protuberances, depending on the degree of desired embossing, may range from about 1.0 to about 5.0 mm, such as from about 1.0 to about 3.0 mm.

The first and second engraved rolls 211, 212 are urged together to form a first nip 210 through which the first tissue ply 201 passes to form a plurality of macrofolds 230 thereon. Generally, a force or pressure is applied to one or both of the rolls 211, 212 such that the rolls 211, 212 are urged against one another causing the first tissue ply 201 to conform to protuberances 214, 216 as it passes through the nip 210. As shown in detail in FIG. 3B, the first tissue ply 201 conforms to protuberances 214, 216 and forms a macrofold 230. As the first tissue ply 201 exits the first nip 210 the macrofold 230 is supported by a protuberance 216 disposed on the second roll 212.

As the macrofold is generally formed by the first ply conforming to the protuberances disposed on the first and second rolls, the shape and size of the macrofold may be controlled to a certain degree by the shape of the protuberances. For example, in certain preferred embodiments, all the protuberances 214 disposed on the first roll 211 may be similarly shaped and sized and all of the protuberances 216 on the second roll 212 may be similarly shaped and sized. In this manner, when the first ply 201 passes through the first nip 210 the resulting macrofolds 230 may all be similarly shaped and sized.

To form a two-ply tissue product, a second parent roll 202 is unwound and the second tissue ply 204 is conveyed around an idler roller 220 and then passed into a second nip 215 formed between an impression roll 217 and an engraved embossing roll 213. The impression roll generally has a smooth outer surface, which may be deformable. In certain instances, the impression roll has an outer covering comprising a natural or synthetic rubber and may have a hardness greater than about 40 Shore (A), such as from about 40 to about 100 Shore (A). The engraved embossing roll 213 generally comprises a plurality of protuberances 222 extending from its peripheral surface 221. In one embodiment the protuberances 222 may comprise a plurality of discrete dot elements and form an embossing pattern. In certain embodiments the protuberances disposed on the engraved embossing roll may have a height of at least about 0.4 mm, such as from about 0.4 to about 2.0 mm.

As the second ply 204 passes through the embossing nip 215 it is imparted with a plurality of embossments 231, which may be arranged to form an embossing pattern. The embossed second ply 224 is then conveyed and brought into facing relation with the first ply 205, which has been provided with a plurality of macrofolds 230, using a marrying roll 240. While in certain instances the engraved embossing roll 213 and impression roll 217 may be arranged relatively close to the first pair of rolls 211, 212 and the marrying roll 240, this is not necessary because the present method does not rely upon registration of the macrofolds and the embossing pattern.

After the embossed second ply 224 leaves the embossing nip 215 it is brought into facing relationship with the macrofolded first ply 205. The two plies 205, 224 are conveyed through a third nip 242 formed between the second roll 212 and a marrying roll 240, which may be a steel roll having a substantially smooth outer surface. The embossed second ply 224 and the macrofolded first ply 205 are joined together as they pass through the third nip 242 to form a multi-ply tissue product 280.

In certain embodiments, after exiting the first nip 210 the macrofolded first ply 205 encounters a gluing unit 250, which comprises an adhesive 251 disposed in a reservoir and an applicator roll 252. Adhesive 251 is transferred to the applicator roll 252 and applied to the macrofold distal ends 232. The macrofolded first ply 205 with the applied adhesive 251 then advances further to the third nip 242 between the second roll 212 and the marrying roll 240. At this point, the embossed second ply 224 is attached to the macrofolded first ply 205 and then conveyed through the third nip 242 to form an adhesively laminated two-ply tissue product 280 which may be subsequently wound into a roll (not shown). The two-ply tissue product 280 comprises a macrofolded first ply 205 and a second embossed ply 224 with the macrofolded first ply 205 forming the upper most surface of the tissue product 280 and the second embossed ply 224 forming the bottom most surface.

In certain embodiments, to improve processability and one or more physical properties, one or more of the fibrous plies may be subjected to preconditioning to impart moisture and/or heat to the tissue plies prior to entering an embossing nip. For example, preconditioning mechanisms may be positioned upstream of the nip located between the engraved roll and the impression role to introduce moisture and/or heat to the first tissue ply prior to embossing. Methods and arrangements for applying moisture and heat (e.g., steam) to tissue webs are known to skilled artisans and can be employed and fall within the scope of the present invention. By way of example, steam can be applied to either or both sides of a web prior to embossing.

The multi-ply tissue products of the present invention may have a basis weight from about 20 to about 90 gsm, such as from about 30 to about 70 gsm, such as from about 42 to about 60 gsm. In certain instances, the multi-ply embossed tissue products may comprise two, three or four tissue plies where the basis weight of each individual tissue ply is less than about 25 gsm, such as from about 10 to about 20 gsm, such as from about 10 to about 15 gsm. In certain instances, the present invention provides a multi-ply tissue product comprising a first macrofolded tissue ply having a basis weight from about 10 to about 42 gsm and a second surface embossed tissue ply having a basis weight from about 10 to about 42 gsm.

In other embodiments, the multi-ply tissue products of the present invention may have a geometric mean tensile (GMT) strength from about 800 to about 1,800 g/3", such as from about 800 to about 1,600 g/3", such as from about 800 to about 1,500 g/3". In a particularly preferred embodiment, the invention provides a tissue product comprising a first macrofolded ply and a second embossed ply, the product having a GMT from about 800 to about 1,800 g/3", such as from about 800 to about 1,600 g/3", such as from about 800 to about 1,500 g/3", and a basis weight from about 30 to about 65 gsm, such as from about 42 to about 60 gsm.

Figure 4:
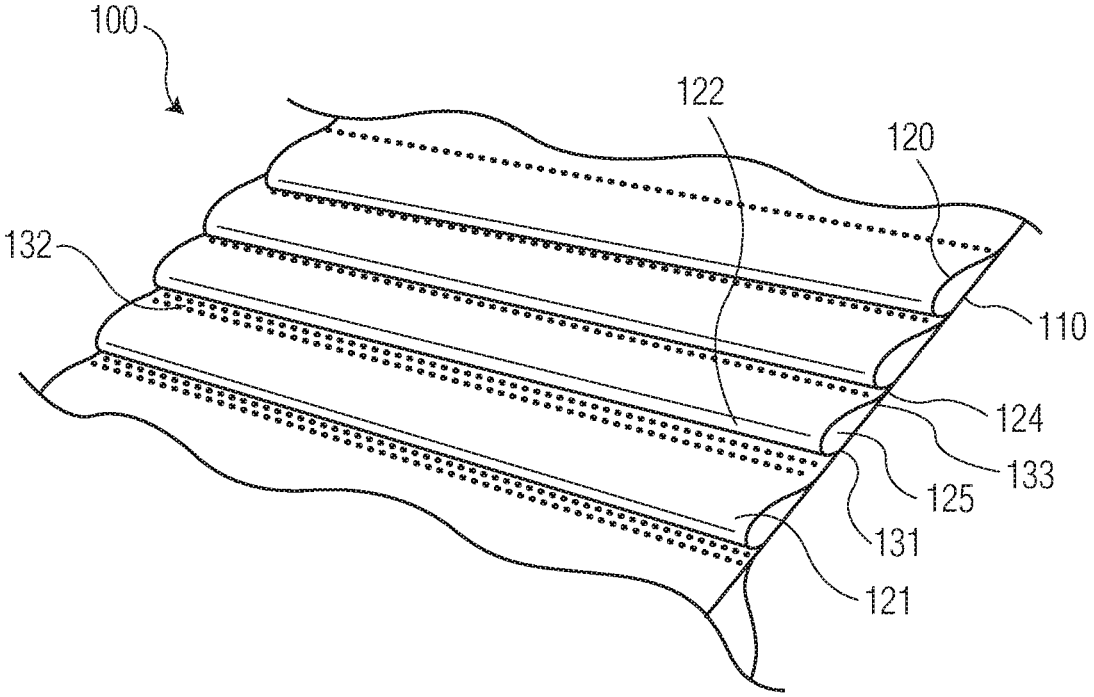
FIG. 4 is a perspective view of a tissue product according another embodiment of the present invention.

With reference now to FIG. 4, the multi-ply tissue web 100 comprises a first and second ply 110, 120. The first ply 110 is substantially planar and the second ply 120, which forms one of the outer most surfaces of the product 100, comprises a plurality of macrofolds 121. The macrofolds 121 extend between first and second points of attachment 131, 133 between the first and second plies 110, 120. The macrofolds 121 extend transversely across the width of the tissue product 100 in the cross-machine direction in a substantially continuous fashion. The macrofolds 121 form voids 125, which like the macrofolds 121, extend transversely across the width of the tissue product 100 in the cross-machine direction in a substantially continuous fashion.

In addition to macrofolds 121, the second, upper, ply 120 further comprises a plurality of embossments 132, which in the illustrated embodiment are discrete dot embossments. The embossments 132, are disposed in an embossing pattern between macrofolds 121, which are spaced apart from one another in the machine-direction. The embossments 132 extend transversely across the width of the multi-ply tissue web 100 in the cross-machine direction.

Figure 5:
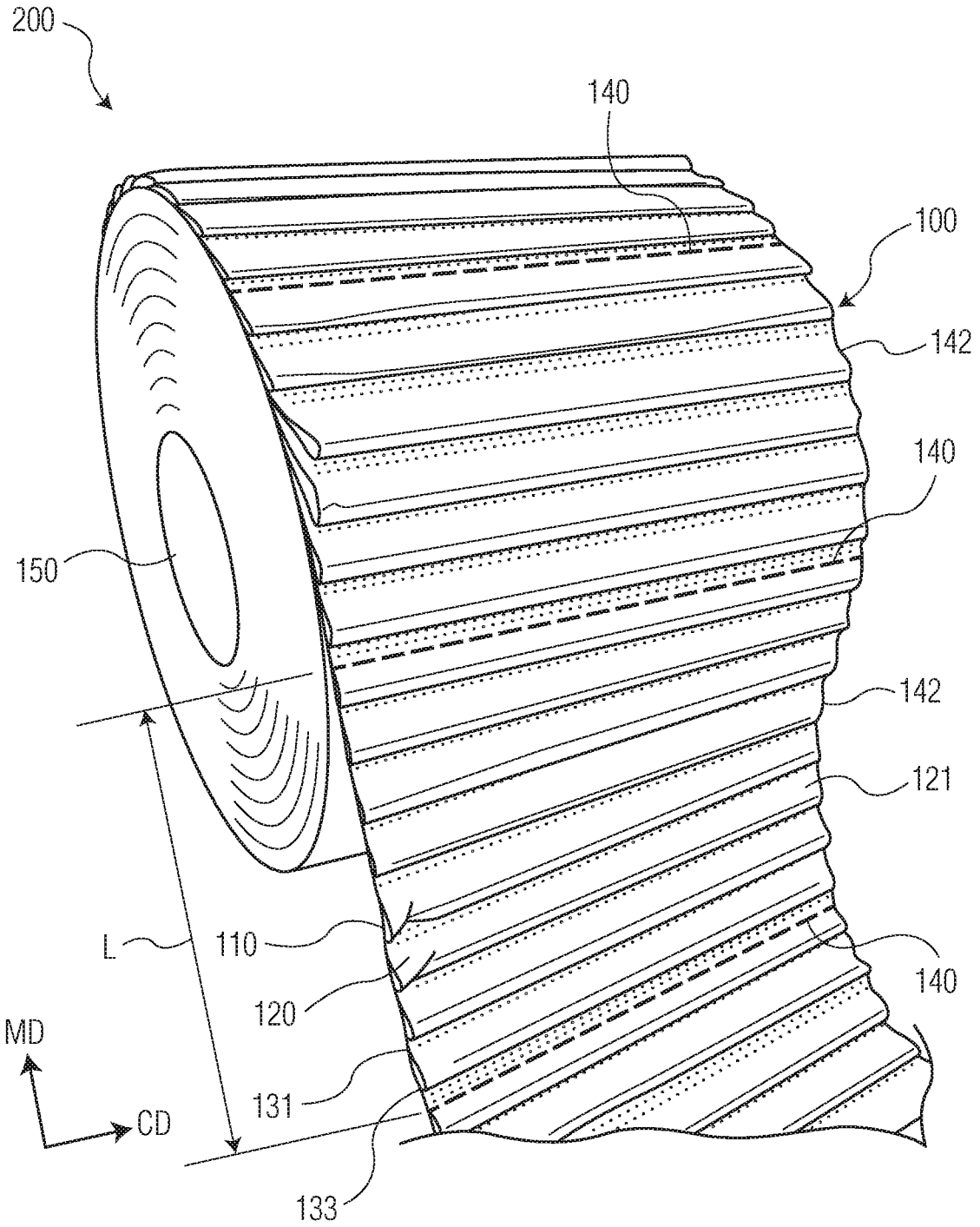
FIG. 5 is a perspective view of a rolled tissue product according to still another embodiment of the present invention.

Turning now to FIG. 5, which illustrates a rolled tissue product 200 according to one embodiment of the present invention. The tissue product 200 comprises a multi-ply tissue web 100 spirally wound about a core 150. The multi-ply tissue web 100 has a machine direction (MD) and a cross-machine direction (CD) and a plurality of transversely extending lines of perforations 140, which are spaced apart from one another in the MD. The spaced apart lines of perforations 140 define individual tissue sheets 142, therebetween. The individual tissue sheets 142 have a MD length (L), also referred to herein as a sheet length.

Each sheet 142 comprises a first and second ply 110, 120. The second, upper, ply 120 comprises a plurality of macrofolds 121 that extend transversely in the CD across the width of the sheet 142 in a substantially continuous fashion. As described previously, the macrofolds 121 are formed by a portion of the upper ply 120 and extend between first and second points of attachment 131, 133, which in certain embodiments may be an adhesive disposed between the first and second plies 110, 120. The formation of macrofolds 121 in the second ply 120, causes the length of tissue web forming the first ply 110 to have a MD length that is greater than the sheet length (L).

In certain preferred embodiments the first, bottom, ply is substantially planar and has a MD length equal to the sheet length (L). The second, upper, ply comprises a plurality of macrofolds, which result in the ply having a MD length that is at least about 150 percent of the sheet length (L). In other embodiments, the MD length of the second ply is from about 120 to about 600 percent of the sheet length (L), such as from about 150 to about 400 percent of the sheet length (L), such as from about 180 to about 300 percent of the sheet length (L).

The MD sheet length of the first and second plies may be measured by separating a sheet from an adjacent sheet along the line of perforations. The separated sheet may then be further separated into individual plies by gently lifting on the upper most ply, generally the ply comprising macros-folds, to separate the plies from one another, taking care not to tear the plies. Once separated into individual plies, the plies are flattened by applying a slight tension to the ends of the plies, which may be accomplished by simply using one's hands to extend the plies, and the MD length is measured using conventional means.

Figure 6:
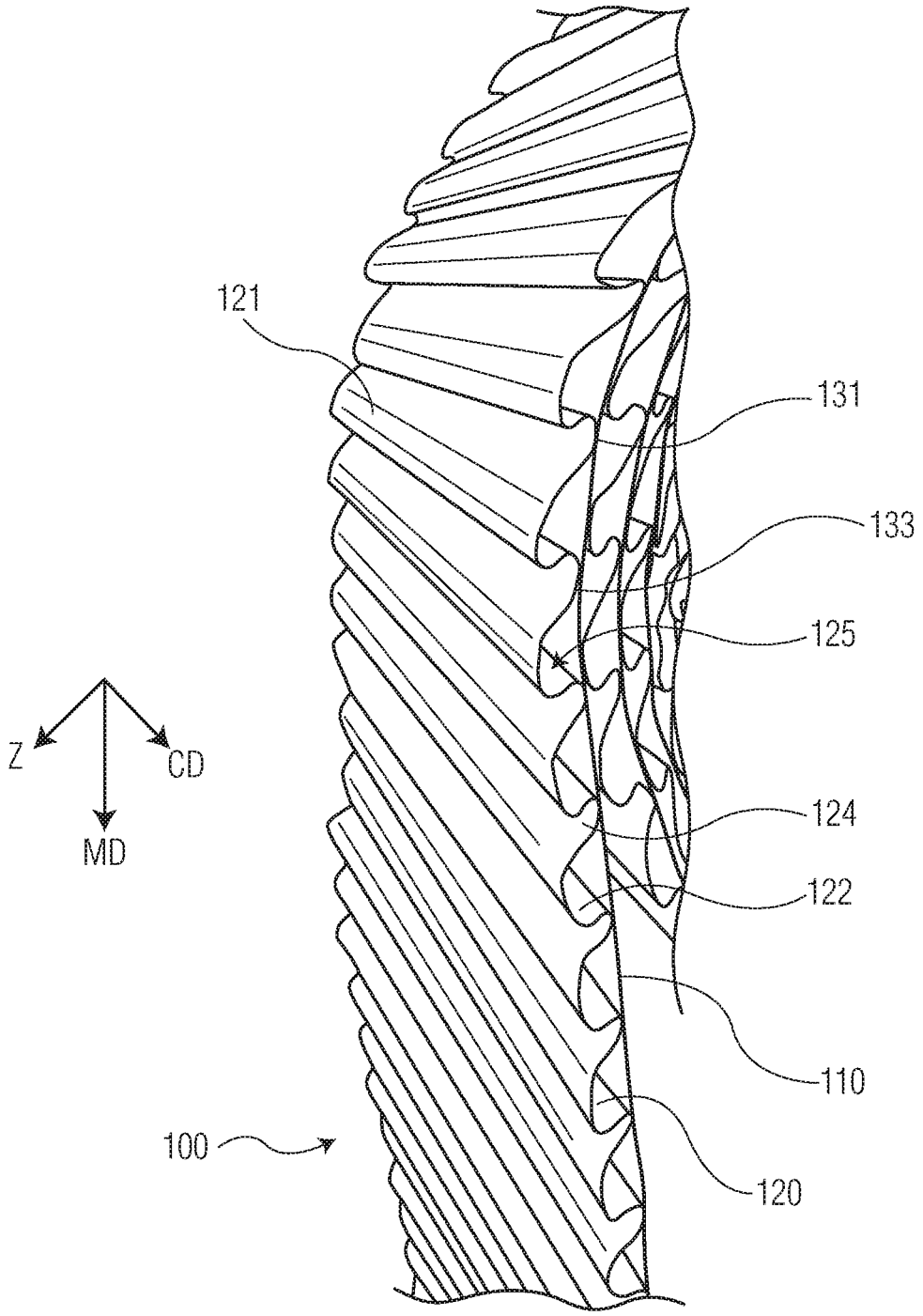
FIG. 6 a perspective view of a rolled tissue product according another embodiment of the present invention.

With reference now to FIGS. 5 and 6, one embodiment of a tissue product having a plurality of macrofolds 121 formed in a first ply 120 of a multi-ply product 100 is illustrated. The points of attachment 131, 133 defining each of the macrofolds 121 are spaced apart an equal distance, such as from about 3 to about 15 mm, such as from about 5 to about 12 mm, such as from about 7 to about 10 mm, to form macrofolds 121 having similar size. In certain instances, the amplitude may range from about 3 to about 20 mm, such as from about 5 to about 15 mm and the wavelength may range from about 8 to about 24 mm, such as from 10 about 22 mm, such as from 12 to about 20 mm.

As further illustrated in FIGS. 5 and 6, the macrofolds 121 may define a void 125 which extends transversely in the cross-machine direction from a first edge of the sheet to the second edge. The voids 125, like the macrofolds that defined them, are also similarly shaped and sized.

In those embodiments, such as illustrated in FIGS. 5 and 6, where the upper ply 120 comprises a plurality of macrofolds 121 and the lower ply 110 is substantially planar, the difference in structure causes the plies 110, 120 to have different machine direction lengths. For example, the macrofolded upper ply 120 may have a MD length that is at least about 150 percent of the MD length of the bottom ply 110. In other embodiments, the MD length of the upper ply 120 is from about 120 to about 600 percent of the bottom ply 110, such as from about 150 to about 400 percent of the bottom ply 110, such as from about 180 to about 300 percent of the bottom ply 110.

Figure 7:
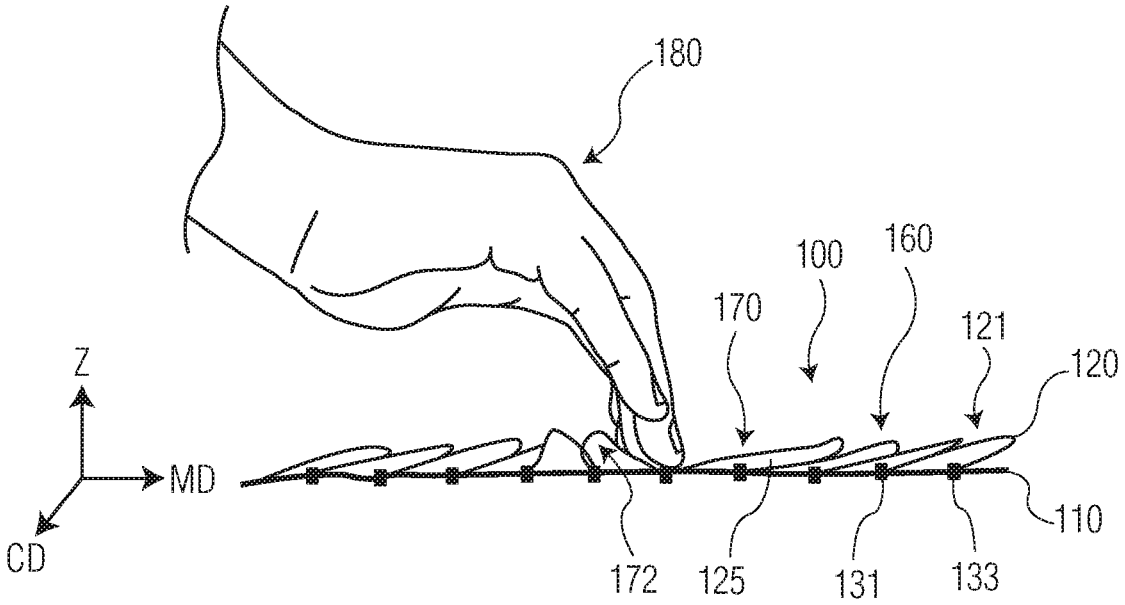
FIG. 7 illustrates a tissue product of the present invention in-use.

In-use, such as illustrated in FIG. 7, the difference in the MD length of the bottom and top plies 110, 120 and particularly the presence of macrofolds 121 in the top ply 120, may provide a product 100 with large degree of surface area that is well suited for wiping and cleaning. For example, a user 180 may contact the upper surface 160 of the product 100 causing the macrofolds 121 to be moved from a first position 170, to a second position 172. As the user contacts and moves the macrofolds a large amount of surface area is contacted, particularly compared to contact with a conventional, substantially planar, tissue product.

What is claimed is:

1. A tissue product having a machine direction (MD) and a cross-machine direction (CD), a first upper surface and an opposed bottom surface, the product comprising:

a first tissue ply having a basis weight from about 10 to about 45 grams per square meter (gsm) and sheet bulk greater than about 5 cubic centimeters per gram (cc/g) and a first MD length, a second tissue ply having a basis weight from about 10 to about 45 grams per square meter (gsm) and sheet bulk greater than about 5 cubic centimeters per gram (cc/g) and a second MD Length, a plurality of substantially CD orientated lines of perforation spaced apart from one another in the MD and defining a plurality of sheets therebetween, the sheets having a sheet length (L);

wherein the first MD Length is substantially equal to the sheet length (L) and the second MD Length is at least about 150 percent of the sheet length (L).

2. The tissue product of claim 1 wherein the first ply is substantially planar, and the second ply comprises a plurality of substantially CD orientated macrofolds defined by points of attachment between the first and second plies, the points of attachment being spaced apart from one another in the MD.

3. The tissue product of claim 2 wherein the points of attachment are substantially equally spaced apart from one another a distance from about 5.0 to about 16 mm in the MD.

4. The tissue product of claim 2 wherein the points of attachment extend substantially continuously in the CD.

5. The tissue product of claim 2 wherein each of the plurality of macrofolds are similarly sized and shaped.

6. The tissue product of claim 2 further comprising a plurality of dot embossments disposed on the second ply between the spaced apart points of attachment.

7. The tissue product of claim 1 wherein the second MD Length is from about 120 to about 600 percent of the sheet length (L).

* * * * *